US006629749B2

(12) United States Patent
Miyauchi et al.

(10) Patent No.: US 6,629,749 B2
(45) Date of Patent: Oct. 7, 2003

(54) CAPPING MECHANISM AND INK JET RECORDING APPARATUS USING SUCH CAPPING MECHANISM

(75) Inventors: Yasuo Miyauchi, Tokyo (JP); Kenji Shigeno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,843

(22) Filed: Oct. 26, 2001

(65) Prior Publication Data

US 2002/0080208 A1 Jun. 27, 2002

(30) Foreign Application Priority Data

Oct. 31, 2000 (JP) ..... 2000-332729

(51) Int. Cl.[7] ..... B41J 2/165
(52) U.S. Cl. ..... 347/32; 347/29; 347/30
(58) Field of Search ..... 347/32, 29, 23, 347/30, 33

(56) References Cited

U.S. PATENT DOCUMENTS

| | | | |
|---|---|---|---|
| 5,663,751 A | 9/1997 | Holbrook | 347/22 |
| 6,132,027 A | 10/2000 | Suzuki et al. | 347/33 |
| 2002/0130920 A1 | 9/2002 | Saijo | 347/31 |

FOREIGN PATENT DOCUMENTS

| | | |
|---|---|---|
| JP | 2-045156 | 2/1990 |
| JP | 2000-103072 | 4/2000 |
| WO | 99/61249 | 12/1999 |

OTHER PUBLICATIONS

European Search Report, EP 01 12 5883, Nov. 15, 2002, De Groot, R.

*Primary Examiner*—Shih-wen Hsieh
(74) *Attorney, Agent, or Firm*—Fitzpatrick, Cella, Harper & Scinto

(57) ABSTRACT

The present invention provides a capping mechanism for protecting a recording head for effecting recording by discharging ink toward a recording medium, comprising a cap movable in directions along which the cap can be contacted with and separated from a discharge port face of the recording head, a cam mechanism for controlling a position of the cap, a shifting mechanism for shifting the cap in said directions, and a biasing mechanism for biasing the cap to be separated from the discharge port face, and wherein the cam mechanism includes first and second cams and the shifting mechanism includes first and second engagement portions so that the first cam is normally engaged with the first engagement portion, and, when the first cam is disengaged from the first engagement portion, the second cam is engaged with the second engagement portion.

12 Claims, 11 Drawing Sheets

CAPPING MECHANISM AND INK JET RECORDING APPARATUS USING SUCH CAPPING MECHANISM

BACKGROUND OF THE INVENTION

1. Field of the Invention

The present invention relates to a capping mechanism for protecting recording means for effecting recording by discharging ink toward a recording medium, and an ink jet recording apparatus using such a capping mechanism.

2. Related Background Art

As recording apparatuses having a printer, copier or facsimile function, or recording (printing) apparatuses used as a an output device for a composite electronic equipment including a computer or a word processor or for a work station, an ink jet recording apparatus in which recording is effected by discharging ink toward a recording medium (recording material) such as paper, cloth, plastic sheet or OHP sheet in response to image information (recording information) has been popularized. Further, there are various requirements for materials of the recording media, and, in recent years, development for meeting such requirements has been progressed, so that recording apparatuses in which cloth, leather, non-woven fabric or metallic sheet, as well as paper (including thin paper or processed paper) or resin thin plate (OHP sheet or the like) as normal recording medium, is used as a recording medium has been proposed.

The ink jet recording apparatus has widely been used as a printer, a copier and a facsimile because it has low noise and low running cost and it can easily be made compact and it permits color recording. Plural discharge ports for discharging ink droplets are provided on a front face of recording means (ink jet recording head) of the ink jet recording apparatus, and each discharge port has of dimension of about several tens of $\mu$. However, recently, the dimension of the discharge port has been reduced more and more as high quality recording has been progressed. The ink droplet is discharged from the discharge port in response to a discharge signal processed in the recording apparatus on the basis of recording data sent from a host machine, thereby recording an image (including a character and/or symbol) on the recording material.

In the above-mentioned ink jet recording apparatus in which the recording is effected by discharging the ink from the recording means toward the recording medium, since the recording is effected by discharging the ink from the minute discharge port, the discharge port may be clogged to cause poor discharging (including non-discharging), thereby deteriorating quality of the recorded image. To avoid this, a recovery unit for maintaining and recovering ink discharging performance of the recording means has been used. As an example, the recovery unit may include a capping mechanism for capping the discharge port of the recording head, suction means adapted to be connected to the capping mechanism in a capping condition and designed to maintain and recover the ink discharging performance by refreshing the ink in the discharge port by sucking and discharging foreign matters such as viscosity-increased ink and/or bubble(s) from the discharge port by negative pressure generated in the capping means by operating a pump, and wiping means for wiping and cleaning foreign matters such as ink adhered to a discharge port face of the recording means.

That is to say, in the ink jet recording apparatus, in order to protect the discharge port face of the recording head (recording means) or to eliminate the clogging due to dirt and/or fixed ink adhered to the discharge port face, the capping mechanism including a rubber cap is provided so that the discharge port face can be capped if necessary. Since the cap must be retarded to a retard position to avoid interfere between the recording head and the cap during the recording operation, the cap is designed to be movable. For example, the cap may be slid laterally (in a carriage scanning direction) to effect capping and retarding or may be shifted in a vertical direction to effect capping and retarding.

However, in the former slide-type cap arrangement, since a carriage must be shifted in a capping areas exceeding out of a recording area, a width-wise dimension of the recording apparatus is increased. In order to avoid such bulkiness of the recording apparatus, it is preferable that the capping and uncapping (retarding) are effected by shifting the cap in an abutting/spacing direction with respect to the discharge port face (for example, a vertical direction). Such a conventional technique is disclosed in Japanese Patent Application Laid-Open No. 2000-103072, in which a cap arm for holding a cap is rotatably supported and a cap position is controlled by a cap cam and a cap arm spring. In this arrangement, a capping (closing) force of the cap relies upon the cap arm spring and a closing ability around the abutment area between the cap and the discharge port face relies upon elasticity of the cap itself. However, due to dispersion in tolerance of parts, if great inclination (displacement) occurs between the recording head and the cap, such displacement cannot be absorbed only by the elasticity of the cap, with the result that partial leakage of the abutment area between the cap and the recording head may occur, thereby making the normal capping operation impossible.

In order to eliminate such inconvenience, it is considered that equalization properties of the contact area of the cap (uniform contacting ability around the cap) is enhanced by interposing a cap spring (urging spring) between the cap and the cap arm to follow the inclination of the recording head thereby to maintain the closing or sealing condition. However, with this arrangement, in the capping condition, the cap arm spring and the cap spring (urging spring) affect an influence upon each other, with the result that a positional posture of the cap may become unstable.

As a technique similar to the above-mentioned conventional arrangement, there is a technique in which the cap is biased by a spring to be retarded from the recording head. That is to say, in this technique, the cap is forcibly shifted in the closing direction by a cam in opposition to the spring acting toward the retard direction and the closing position (capping position) is determined by dimensions of various parts. In this arrangement, since the closing ability of the abutment area between the cap and the recording head becomes unstable, in order to correct such unstability, a cap spring is disposed between the cap and a cap holding member so that equalization properties of the cap (uniform contacting ability around the cap) is enhanced by the spring. In such an arrangement, unlike to the conventional technique in which the cap is forcibly held at the closing position by the cam, since the cap holding member is stably supported at the closing position (capping position) by the cam, capping pressure is determined by the cap spring, with the result that the positive capping condition can be maintained while ensuring the equalization function (uniform contacting ability around the cap).

However, in such an arrangement, if the apparatus is left as it is for a certain term in the capping condition, the cap may be fixedly adhered to the discharge port face of the recording head with which the cap is closely contacted, with the result that the cap cannot be separated (peeled) from the discharge port face only by the force of the returning spring, thereby generating error in the opening/closing operation of the cap. Incidentally, also in this case, although the operational error can be eliminated by setting the spring force of the returning spring to have a great value, in this case, load torque is also increased accordingly, with the result that additional countermeasure to torque increase of a drive motor and deformation/wear of various parts is required, thereby increasing the cost of the apparatus. Namely, it is not preferable to have excessive burden due to rare inconvenience generated by the adhesion between the recording head and the cap.

SUMMARY OF THE INVENTION

An object of the present invention is to provide a capping mechanism in which, even if a cap is adhered to recording means, an opening/closing operation of the cap can be effected positively and correctly without increasing a returning force, and an ink jet recording apparatus using such a capping mechanism.

Another object of the present invention is to provide a capping mechanism for protecting recording means for effecting recording by discharging ink toward a recording medium, which comprises a cap movable in directions along which the cap can be contacted with and separated from a discharge port face of the recording means, cam means for controlling a position of the cap, shifting means for shifting the cap in the above-mentioned directions, and biasing means for biasing the cap to be separated from the discharge port face, and in which the cam means includes first and second cams and the shifting means includes first and second engagement portions so that the first cam is normally engaged with the first engagement portion, and, when the first cam is disengaged from the first engagement portion, the second cam is engaged with the second engagement portion.

A further object of the present invention is to provide a capping mechanism for protecting recording means for effecting recording by discharging ink toward a recording medium, which comprises a cap movable in directions along which the cap can be contacted with and separated from a discharge port face of the recording means, cam means for controlling a position of the cap, and biasing means for biasing the cap to be separated from the discharge port face, and in which the cam means includes first and second cams and a cap holding member for holding the cap includes first and second engagement portions so that the first cam is normally engaged with the first engagement portion, and, when the first cam is disengaged from the first engagement portion, the second cam is engaged with the second engagement portion.

According to the present invention, even if the recording means is adhered to the cap, an adhered condition can be released without aiding of a force of the biasing means, with the result that an error in an opening/closing operation of the cap due to the adhesion between the recording means and the cap can be eliminated, thereby realizing correct opening/closing operation of the cap, and, since setting force of the biasing means is not required to be increased, increase in load torque and increase in deformation/wear of parts can be eliminated.

DETAILED DESCRIPTION OF THE PREFERRED EMBODIMENTS

The present invention will now concretely be explained in connection with embodiments thereof with reference to the accompanying drawings.

Figure 10:
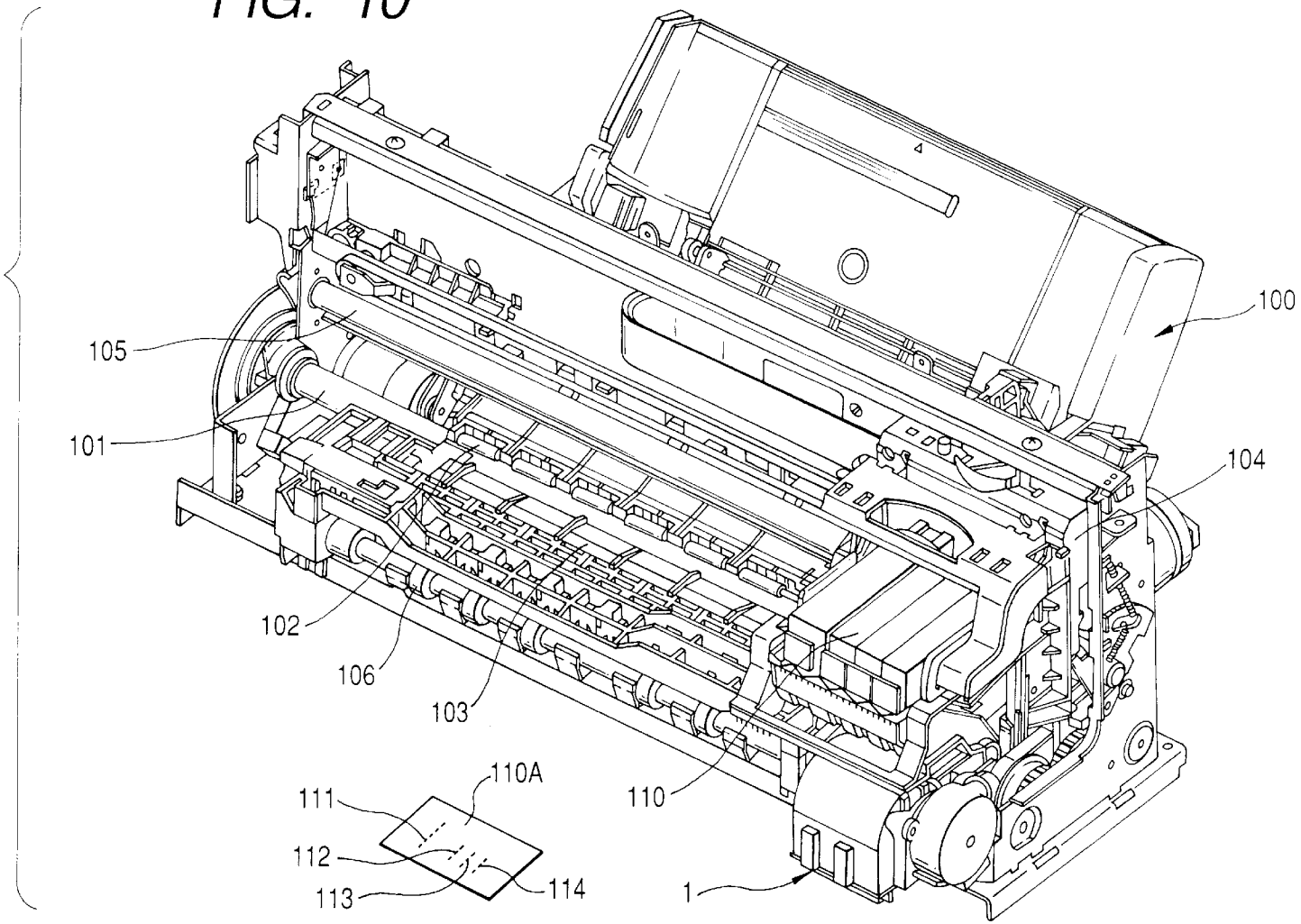
FIG. 10 is a schematic perspective view showing an embodiment of an ink jet recording apparatus to which the present invention is applied.

FIG. 10 is a schematic perspective view showing an embodiment of an ink jet recording apparatus to which the present invention is applied. In FIG. 10, a recording medium (recording paper and the like) supplied by sheet feeding means 100 is pinched between and conveyed by a conveying roller 101 and a pinch roller 102 to be sent onto a plate-shaped platen 103. On the platen, line recording is effected on the recording medium by supported by the platen 103 by discharging ink from recording means (recording head) 110 mounted on a carriage 104 in response to image information while shifting the carriage along a guide shaft 105.

After one-line recording is finished, the conveying roller 101 is rotated by a predetermined amount so that the recording medium is conveyed (fed) up to a position where a portion of the recording medium on which next recording is effected is opposed to the recording head 110. After such a conveying operation is finished, the carriage 104 is shifted (main scanning) again; meanwhile, the next recording is effected by driving the recording head 110 in response to image information. By repeating such a series of operations, all predetermined recording data are recorded or recording of all area of the recording medium (recording sheet) is finished. Thereafter, the recording medium is discharged out of the recording apparatus by sheet discharge rollers 106, thereby finishing the recording.

The recording means (recording head) 110 can perform color recording by using plural color inks and has plural rows of discharge ports (plural ink discharge portions) corresponding to kinds of inks. The discharge port rows are spaced apart from each other by a predetermined pitch in a carriage scanning direction (main scanning direction). Further, the recording means (recording head) having the plural rows of discharge ports may be constituted by a plurality of discrete recording head portions (ink discharge portions) for respective discharge port rows (respective ink discharge portions) or may be constituted as integral recording means including one or two recording means having plural discharge port rows.

The recording means (recording head) 110 is ink jet recording means for discharging the ink by utilizing thermal energy and has electrothermal converters for generating the thermal energy. Further, the recording head 110 serves to effecting the recording by discharging the ink by utilizing change in pressure (change in condition) caused by growth and contraction of a bubble generated by film-boiling effected by the thermal energy given by the electrothermal converter.

Figure 11:
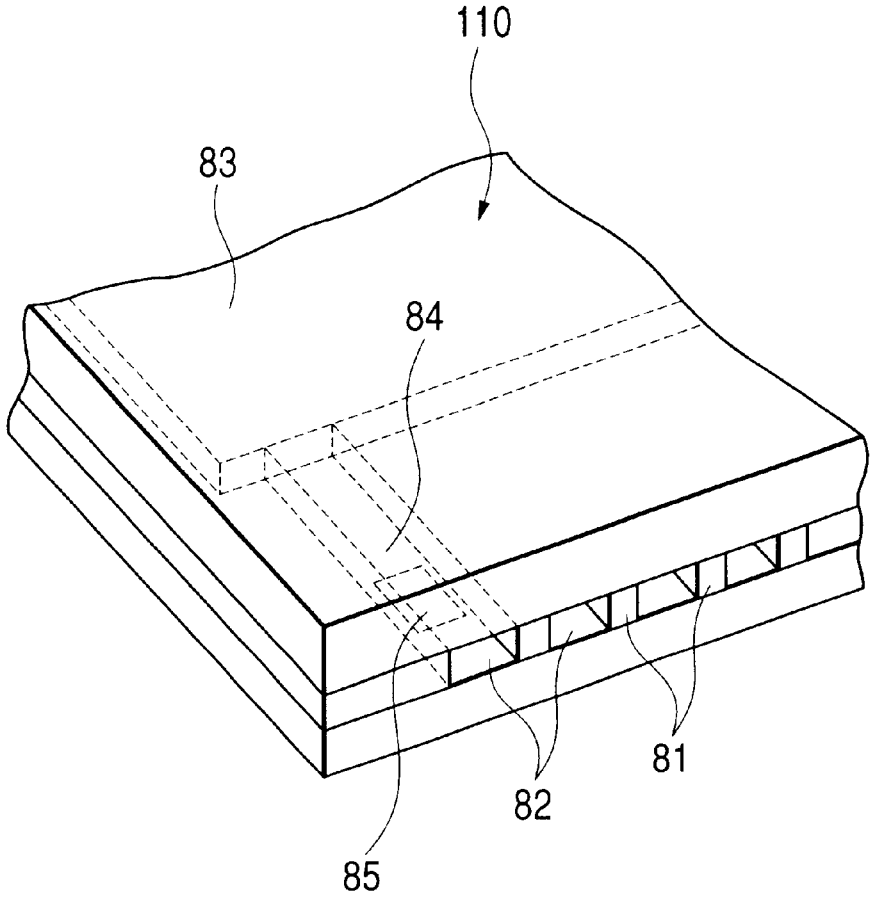
FIG. 11 is a partial perspective view schematically showing a structure of an ink discharge portion of recording means of FIG. 10.

FIG. 11 is a partial perspective view schematically showing a structure of the ink discharge portion (one of discharge port rows) of the recording head 110 of FIG. 10. In FIG. 11, a discharge port face 81 opposed to the recording medium such as the recording paper with a predetermined gap (for example, about 0.3 to 2.0 mm) therebetween is provided with a plurality of discharge ports 82 at a predetermined interval, and electrothermal converters (heat generating resistance members) 85 for generating ink discharging energy are disposed along walls of liquid paths 84 communicating the respective discharge ports 82 to a common liquid chamber 83. In the illustrated embodiment, the recording head 110 is mounted on the carriage 104 in such a manner that the discharge ports 82 are arranged side by side along a direction perpendicular to the scanning direction of the carriage 104. In this way, there is provided the recording means (recording head) 110 in which the film-boiling is generated in the ink within the liquid path 84 by driving (energizing) the corresponding electrothermal converter 85 in response to an image signal or a discharge signal and the pressure generated thereby causes the ink to discharge from the discharge port 82.

110A in FIG. 10 is an explanatory view schematically showing the integral discharge port face in which a plurality (four) of discharge port rows 111, 112, 113, 114 of the recording means 110 are formed. For color recording, for example, the discharge port row 111 includes plural discharge ports for discharging black ink, the discharge port row 112 includes plural discharge ports for discharging cyan ink, the discharge port row 113 includes plural discharge ports for discharging magenta ink, and the discharge port row 114 includes plural discharge ports for discharging yellow ink. In FIG. 10, a recovery unit 1 for maintaining and recovering ink discharging performance of the recording means (recording head) 110 by preventing clogging of the recording means is disposed at a predetermined position (right in FIG. 10) out of a recording area of the ink jet recording apparatus.

The recovery unit 1 includes a capping mechanism for covering (capping) the recording head (discharge port face thereof) to protect the discharge port face 81 of the recording head 110 in a non-recording condition and to reduce evaporation of ink from the discharge ports 82. Further, when the recording is effected again after the head has been capped for a long term, suction recovery processing for sucking and discharging the ink from the discharge ports 82 is performed before the re-recording in order to stabilize the ink discharging by removing the ink (viscosity increased ink) solidified around the discharge ports. The suction recovery processing is carried out by operating a pump (suction pump) connected to the cap in the capping condition. As such a pump constituting suction means, a tube pump of type in which negative pressure is generated by rolling a roller (pressurizing roller) while squeezing a tube connected to the cap and the ink in the recording head is sucked and discharged by the negative pressure is used.

Figure 1:
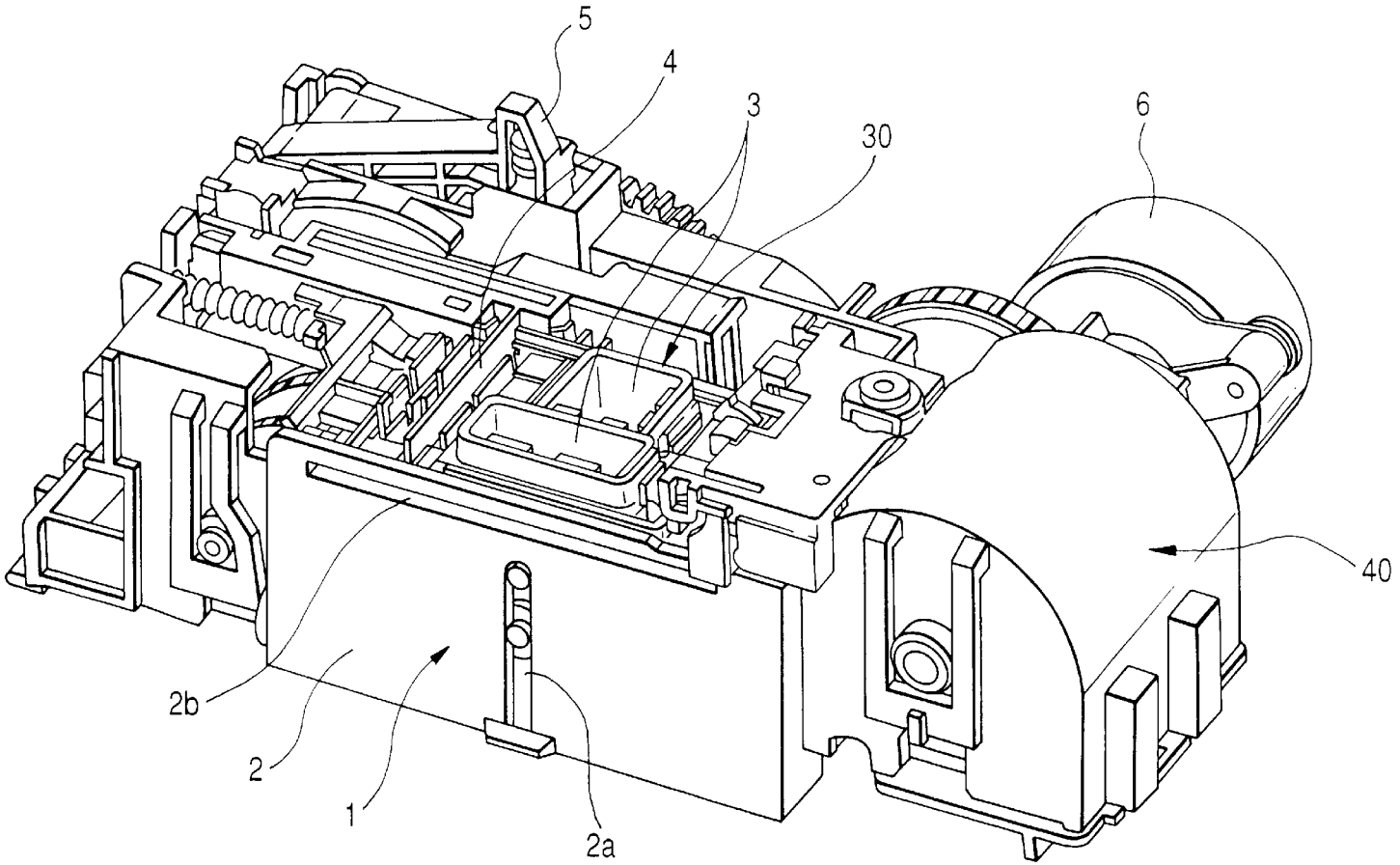
FIG. 1 is a schematic perspective view showing a recovery unit of an ink jet recording apparatus having a capping mechanism to which the present invention is applied.
Figure 2:
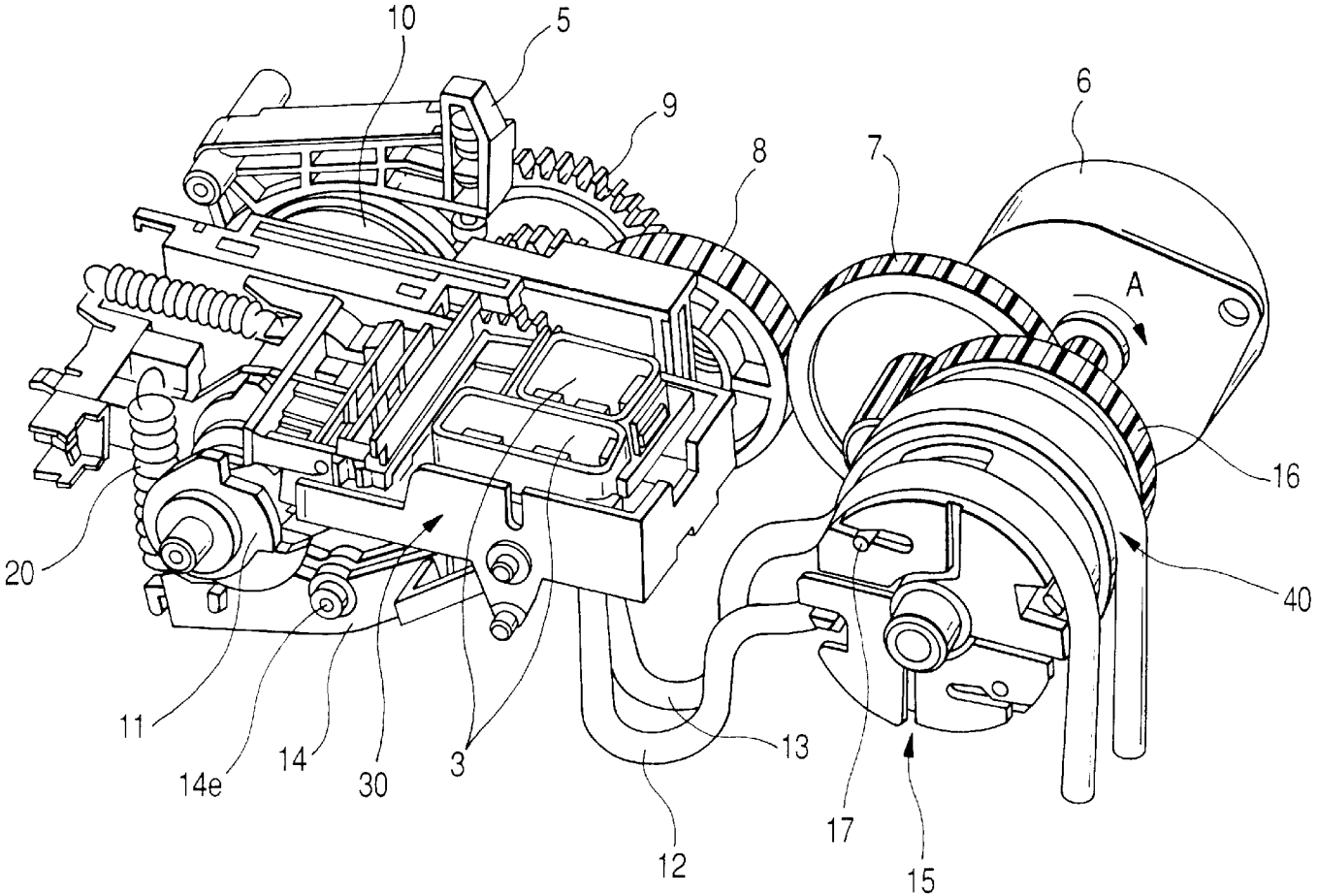
FIG. 2 is a schematic perspective view showing an internal construction of the recovery unit of FIG. 1.

FIG. 1 is a perspective view of the recovery unit 1 and FIG. 2 is a perspective view showing an internal construction of the recovery unit. In FIGS. 1 and 2, the recovery unit 1 has a cap 3 for covering the discharge port face of the recording means (recording head) 110, and a capping mechanism 30 operable to engage and disengage the cap 3 with respect to the discharge port face by shifting the recovery unit in a vertical direction along a vertical guide 2*a* of a base 2. The recovery unit 1 also includes a wiping mechanism having a blade 4 for wiping (cleaning) the discharge port face of the recording head 110 by reciprocal movement along a horizontal guide 2*b*, a carriage lock mechanism having a rocking member (carriage lock) 5 capable of engaging with the carriage to prevent inadvertent movement of the carriage 104 (FIG. 10) in a condition that the discharge port face is sealed by the cap 3 (capping condition), and a suction recovery mechanism 40 operable to refresh the ink in the discharge ports by discharging foreign matters such as viscosity-increased or solidified ink, bubble and dirt together with the ink from the discharge ports of the recording head 110 by driving a suction pump (negative pressure generating means) connected to the cap 3 in the capping condition. In the construction of the recovery unit 1, the capping mechanism 30 constitutes a part of the suction recovery mechanism.

Operations of the capping mechanism 30, wiping mechanism and carriage lock mechanism are effected by transmitting one-way rotation of a driving force transmitted from a motor 6 through gear trans 7, 8, 9 to a main cam 11 via a one-way clutch gear 10 thereby to rotate the main cam 11. That is to say, the main cam 11 has a plurality of longitudinal cams so that rotation of the main cam 11 is converted into rotation of the carriage lock 5 by one of the cams, the rotation of the main cam 11 is converted into a horizonal reciprocal movement of the blade 4 by another cam and blade driving means, and the rotation of the main cam 11 is converted into a reciprocal shifting movement (vertical reciprocal movement in the illustrated embodiment) of the cap 3 by the other cam and a lever 14.

The cap 3 is of two-chamber type including a black discharge port chamber for covering a black ink discharge portion of the recording head 110, and a color discharge port chamber for covering color ink discharge portions (cyan, magenta and yellow discharge portions) of the recording head 110. The two chambers of the cap 3 are connected to tubes 12, 13, respectively, and these tubes are arranged along an arcuated guide surface of the base 2, and a pressurizing roller rolling along the tubes while squeezing the tubes constitutes a tube pump as the negative pressure generating means (suction pump).

That is to say, in FIG. 2, there is provided pressurizing roller holding means 15 rotatable around a center axis of the arcuated guide surface, and the driving force of the motor 6 is transmitted to a pump gear 16 secured to one end of the pressurizing roller holding means 15, and, by rotating the pressurizing roller holding means 15 via the pump gear 16, the tubes 12, 13 are squeezed while being deformed. In the illustrated embodiment, the other directional rotation of the motor 6 causes the pressurizing roller holding means 15 to rotate, thereby squeezing the tubes 12, 13. By such squeezing operation, the ink is sucked from the discharge ports of the recording head 110 due to negative pressure generated in the tubes 12, 13 (suction recovery).

Namely, when the motor 6 is rotated in a direction shown by the arrow A, the tube pump (suction recovery mechanism) is operated. In this case, the one-way clutch gear 10 is idly rotated not to rotate the main cam 11, with the result that the capping mechanism 30 (cap 3), wiping mechanism (blade 4) and carriage locking mechanism (carriage lock 5) are still stopped. When the motor 6 is rotated in a reverse direction, the capping mechanism 30, wiping mechanism and carriage locking mechanism are operated at predetermined timings. In this case, the roller 17 is released from the tubes 12, 13 not to drive the pump.

Figure 3:
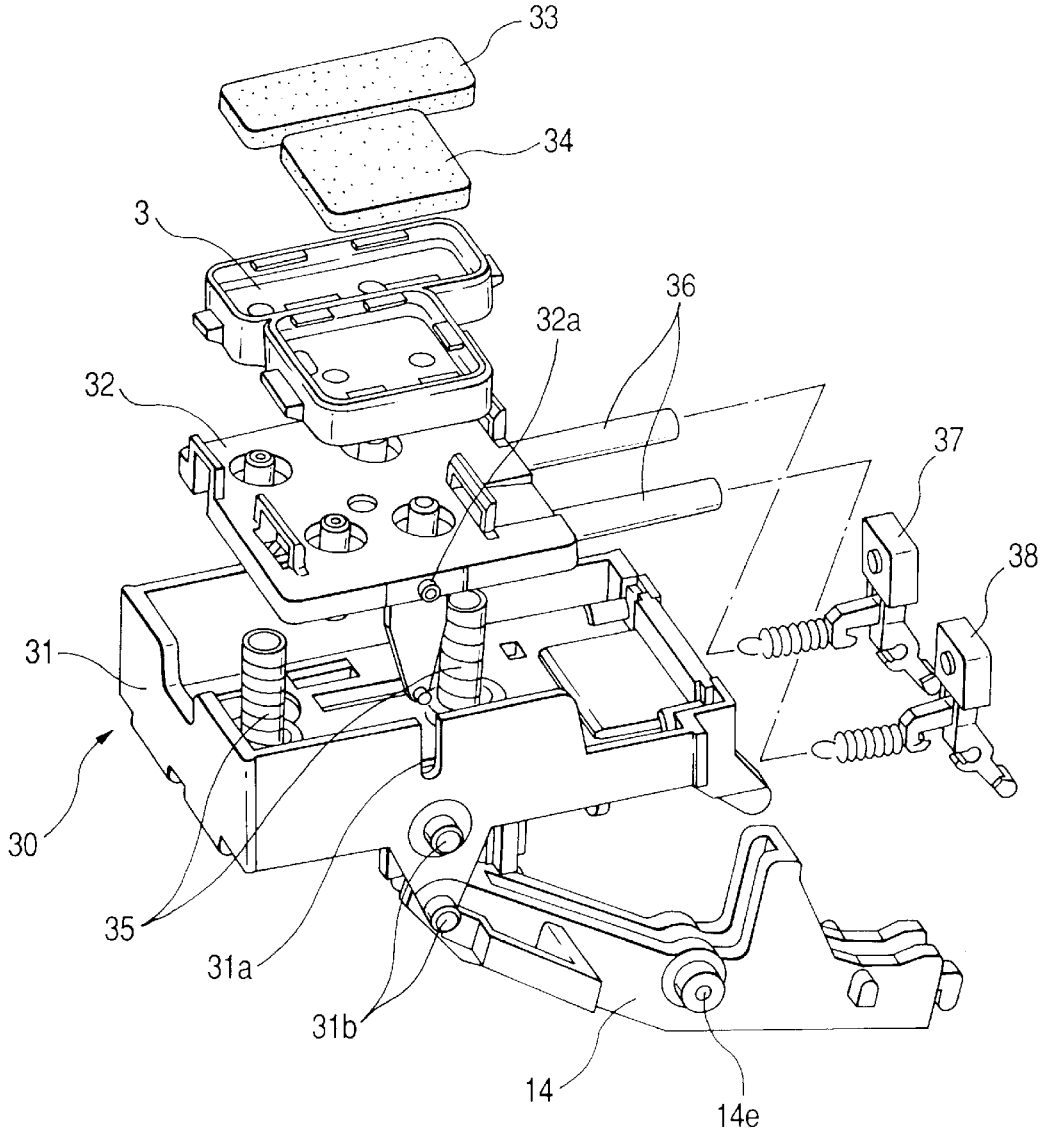
FIG. 3 is a schematic exploded perspective view showing a construction of a capping mechanism according to a first embodiment of the present invention.

Next, the construction of the capping mechanism 30 including the cap 3 will be explained. FIG. 3 is an exploded perspective view showing a first embodiment of the capping mechanism to which the present invention is applied. In FIG. 3, a cap holding member (cap holder) 32 is rockably supported on a cap base 31 by fitting a support shaft 32*a* of the cap holding 32 into a guide groove 31*a* of the cap base 31. The cap 3 is incorporated into and fixed to the cap holder 32. Ink absorbing members 33, 34 are disposed within the cap 3 (in two chambers thereof) for absorbing the ink sucked from the discharge ports of the recording head 110.

Two openings are formed in each chamber of the two-chamber type cap 3, and each chamber is connected to the tube pump (suction recovery mechanism) by connecting the tubes 12, 13 to one of the openings of the chambers. The other openings of the chambers are connected to tubes 36, 36 and the other ends of these tubes 36 can be opened and closed by valves 37, 38. Namely, by controlled the opening/closing timing of the valves 37, 38, independent ink suction from the black ink discharge ports or color ink discharge ports can be effected, or idle suction after the suction can be effected in the capping condition.

Further, cap springs 35 (two biasing springs in the example of FIG. 3) as biasing members are disposed between the cap base 31 and the cap holding member (cap holder) 32. By providing such biasing members (cap springs) 35, when the cap 3 is retarded, the cap is held at a predetermined position by a stopper pawl, and, in the capping, the cap springs (biasing members) 35 are charged (compressed in the illustrated embodiment) to afford required pressure sufficient to maintain the sealing condition between the recording head and the discharge port face. Bosses 31*b* are formed on both sides of the cap base 31 so that, by engaging these bosses 31*b* by the guide groove 2*a* of the base 2, the cap base 31 is held for predetermined directional movement (vertical movement in the illustrated embodiment) with respect to the base 2.

As shown in FIGS. 2 and 3, the shifting (vertical movement) of the cap base 31 is effected via a lever (cap lever) 14 as shifting means rockably supported by a support shaft 14*e* of the recovery unit 1. The cap lever (shifting means) 14 is biased by a return spring 20 as biasing means in a direction along which the capping mechanism 30 is retarded from the recording head 110. The shifting of the capping mechanism 30 to the capping condition (lifting movement in the illustrated embodiment) is effected by rotating the main cam 11 to displace the cap lever 14 by the predetermined cam of the main cam. In this case, although the capping position (lifted position) of the cap base 31 is dispersed due to tolerance of parts, in the illustrated embodiment, the actual capping pressure (contact force with the discharge port face) is determined by the biasing members (cap springs) 35, and, even if the recording head 110 is inclined, since the equalization properties (uniform contacting ability around the cap) is provided to permit the cap 3 and the cap holder (cap holding member) 32 to follow such inclination, the cap 3 can be uniformly urged against the discharge port face, thereby positively maintaining the capping condition.

Figure 4:
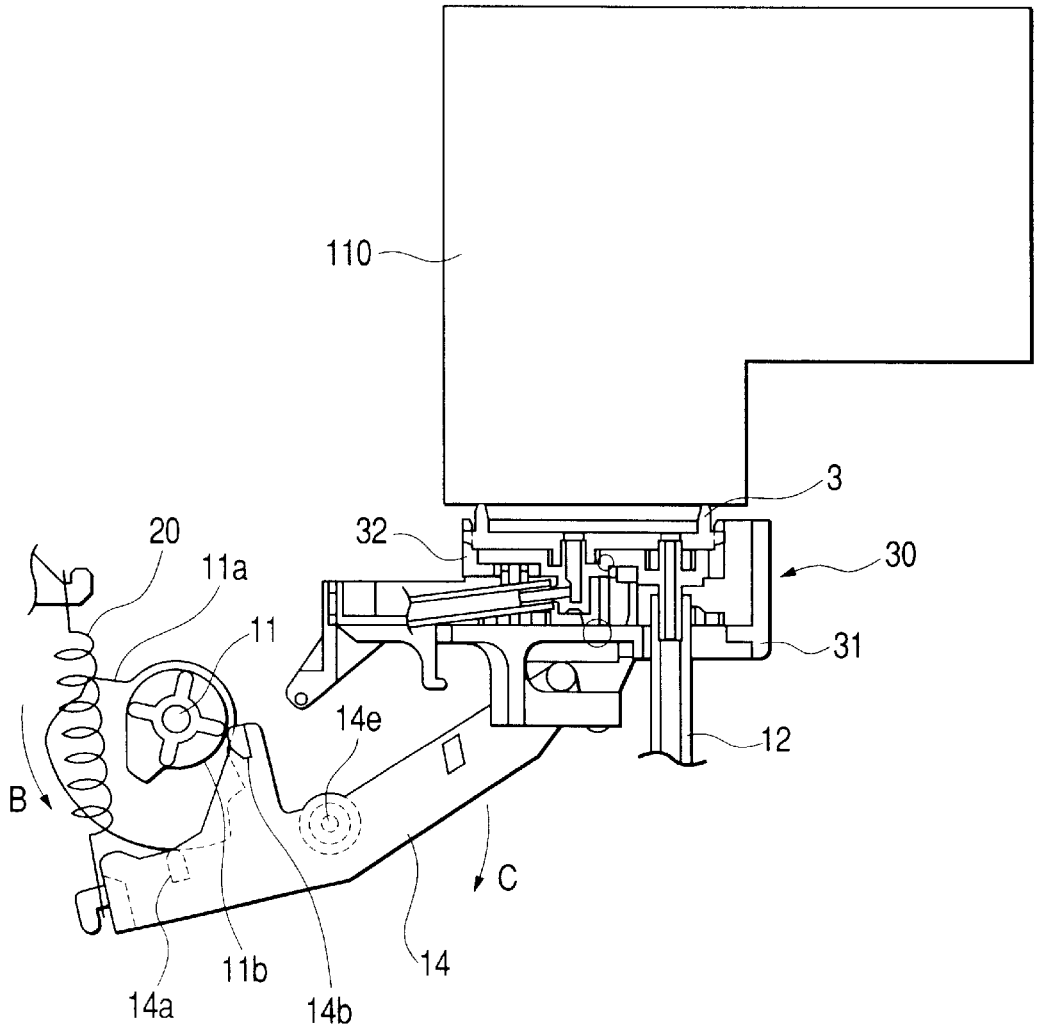
FIG. 4 is a schematic longitudinal sectional view showing a condition that the capping mechanism according to the first embodiment of the present invention is in a capping position.

Next, the capping operation of the capping mechanism 30 according to the first embodiment (FIG. 3) of the present invention will be explained. FIG. 4 is a longitudinal sectional view showing a condition that the capping mechanism 30 (including a part of a driving mechanism) of the first embodiment is positioned at the capping position (closed position), FIG. 5 is a longitudinal sectional view showing a condition that the cap 3 adhered to the recording head 110 is peeled while lowering the cap base from the capping position, and FIG. 6 is a longitudinal sectional view showing a condition that the capping mechanism 30 of the first embodiment is positioned at the retard position spaced apart from the recording head 110.

Figure 5:
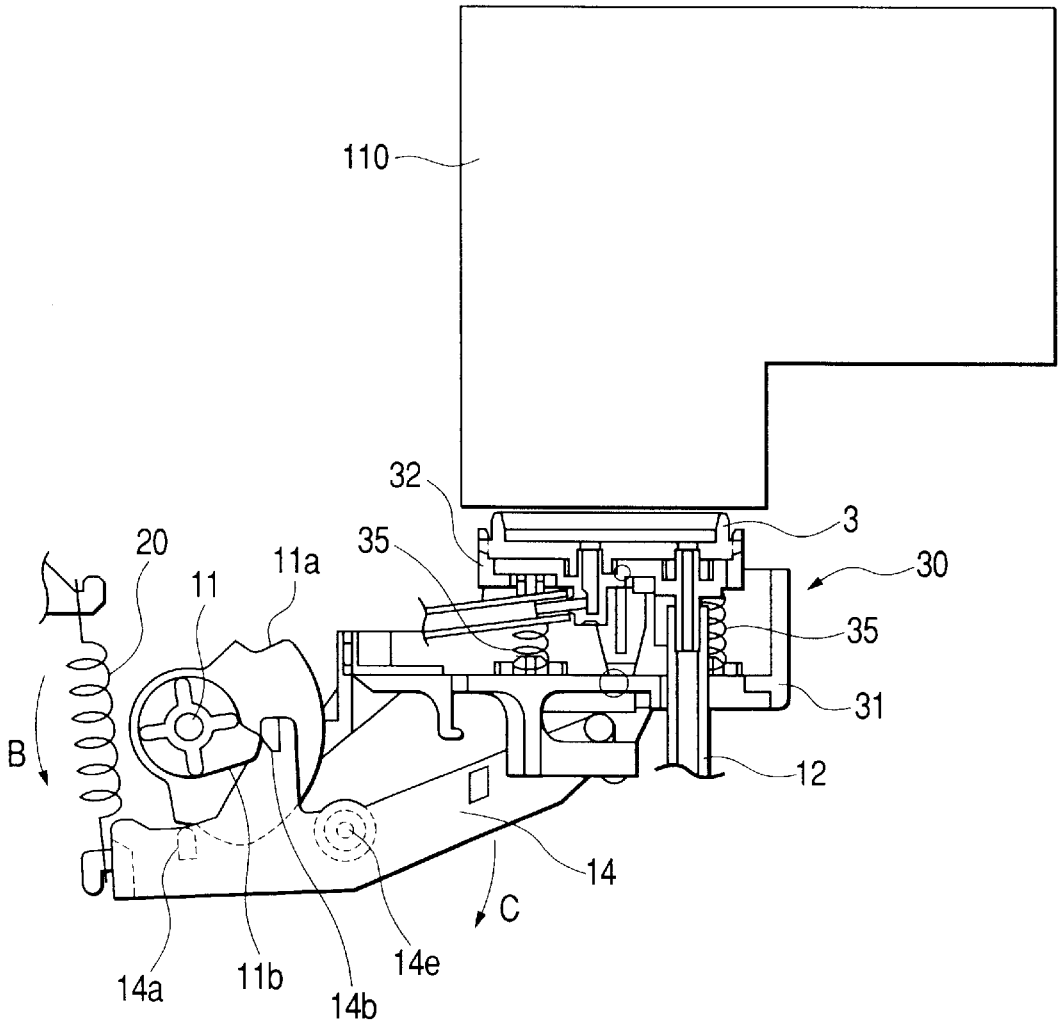
FIG. 5 is a schematic longitudinal sectional view showing a condition that the capping mechanism of FIG. 4 peels the cap adhered to the recording means.
Figure 6:
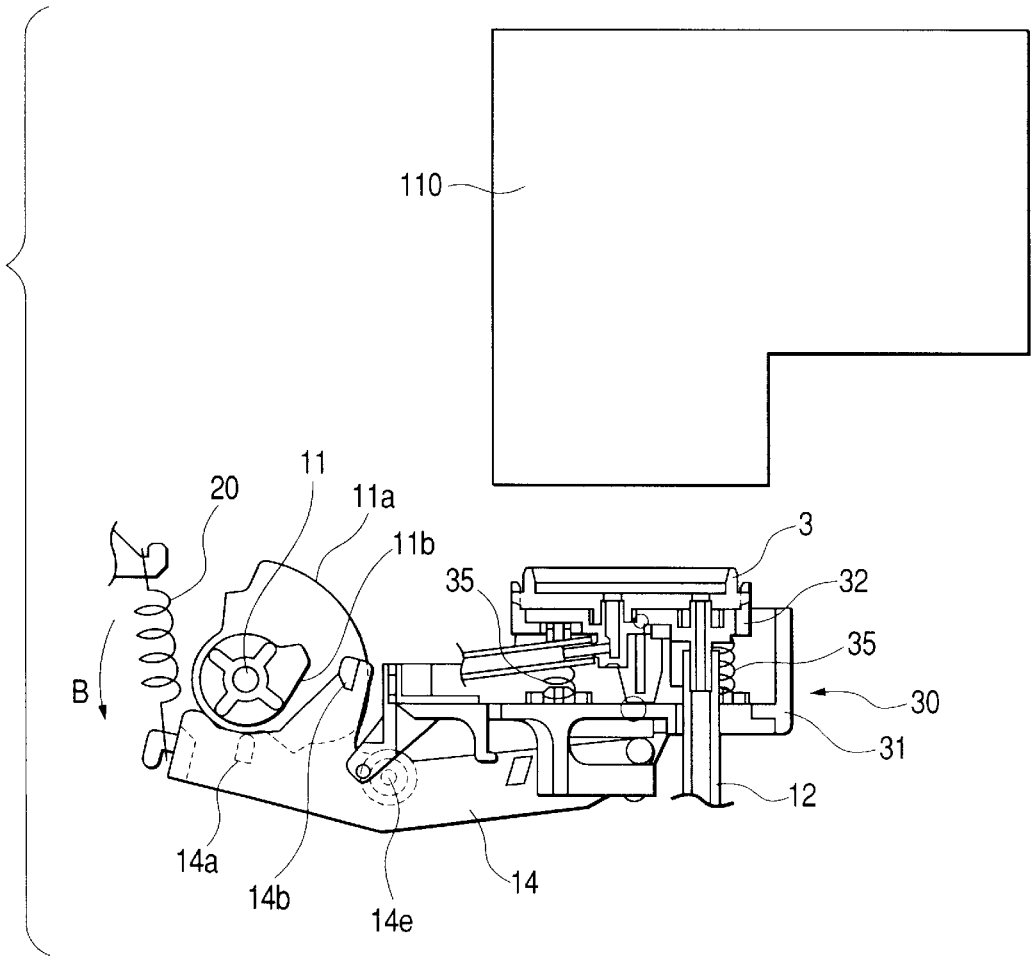
FIG. 6 is a schematic longitudinal sectional view showing a condition that the capping mechanism of FIG. 4 is positioned in a retard position spaced apart from the recording means.

The capping mechanism according to the first embodiment shown in FIGS. 4 to 6 serves to protect the recording means (recording head) for effecting the recording by discharging the ink toward the recording medium and includes the cap 3 movable in directions along which the cap can be contacted with and separated from the discharge port face of the recording means 110, cam means (main cam 11) for controlling the position of the cap, shifting means (cap lever 14) for shifting the cap in the above-mentioned directions, and biasing means (return spring 20) for biasing the cap to be separated from the discharge port face, and in which the cam means includes first and second cams 11*a*, 11*b* and the shifting means includes first and second engagement portions 14*a*, 14*b* so that the first cam is normally engaged with the first engagement portion, and, when the first cam is disengaged from the first engagement portion, the second cam is engaged with the second engagement portion.

That is to say, in the condition that the cap 3 of FIG. 4 is in the closed position (capping position), the first engagement portion 14*a* of the cap lever as the shifting means is engaged by the first cam 11*a* of the main cam 11 as the cam means, with the result that the cap lever 14 rockably supported by the support shaft 14*e* is forcibly displaced in an anti-clockwise direction in opposition to the return spring 20, thereby displacing the cap base 31 to the uppermost position. As mentioned above, since the cap 3 and the cap holding member 32 are biased toward the recording head 110 by the biasing members (cap springs) 35 on the cap base 31 to urge the rubber elastic cap 3 against the recording head 110, the capping condition can be maintained by the optimum urging force with the equalization properties (uniform contacting ability around the cap), as the equalization operation (uniform contacting around the cap)is performed.

When the main cam 11 is rotated in a direction shown by the arrow B, the cap lever (shifting means) 14 is rotated by the return spring (biasing means) 20 in a direction shown by the arrow C around the support shaft 14*e* in a condition that the first cam 11*a* is engaged by the first engagement portion 14*a*, thereby lowering the cap base 31 downwardly to be spaced apart from the recording head 110. However, rarely, during the capping condition, the cap 3 may be adhered to the recording head 110, with the result that the cap 3 may not be peeled from the recording head 110 only by the force of the return spring (biasing means) 20.

To cope with this, in the illustrated embodiment, as shown in FIG. 5, when the first cam 11*a* is disengaged from the first engagement portion 14*a* (normally, when only separated), the second cam 11*b* is engaged by the second engagement portion 14*b*. With this arrangement, even if the cap 3 is adhered to the recording head 110 not to be peeled from the recording head only by the return spring (biasing means) 20, the cap base 31 can forcibly be shifted toward the retard position (downward direction) by forcibly shifting the shifting means (cap lever) 14 in the direction C. Namely, even if the cap 3 is adhered to the recording head 110, regardless of the force of the return spring 20, the cap 3 can positively be peeled from the recording head 110, thereby releasing the capping operation positively. Once the cap 3 is peeled, since the first cam 11*a* is engaged by the first engagement portion 14*a* again, the normal operation can be restored.

When the main cam 11 is further rotated in the direction B, as shown in FIG. 6, the cap lever 14 as the shifting means is further rotated by the return spring (biasing means) 20 in a clockwise direction (direction C in FIG. 5) around the support shaft 14*e* in the condition that the first cam 11*a* is engaged by the first engagement portion 14*a*, thereby lowering the cap base 31 to the lowermost position thereby to bring the cap 3 to the retard position spaced apart from the recording head 110.

According to the first embodiment explained in connection with FIGS. 3 and 6, since the capping mechanism 30 shiftable to be engaged and disengaged with respect to the recording means 110 is biased toward the retard direction by the return spring 20 as the biasing means and the position of the cap 3 of forcibly regulated by the first cam 11*a* of the main cam (cam means) 11 and, if the engagement of the first cam is released due to adhesion between the cap 3 and the recording head 110 (normally, when only separated), the cap is peeled from the recording head by the second cam 11*b*, even if the cap is adhered to the recording means, the adhering condition can be released without the aid of the force of the return spring (biasing means).

Thus, there can be provided a capping mechanism in which the opening/closing error of the cap due to the adhesion between the recording means 110 and the cap 3 can be eliminated thereby achieving the correct opening/closing operation of the cap, and further, since the setting force of the return spring as the biasing means is not required to be increased, increase in load torque and increase in deformation/wear of the parts can be avoided, and an ink jet recording apparatus using such a capping mechanism. Further, there can be provided a capping mechanism having fewer number of parts and easy and cheap construction and achieving the above-mentioned effect.

Figure 7:
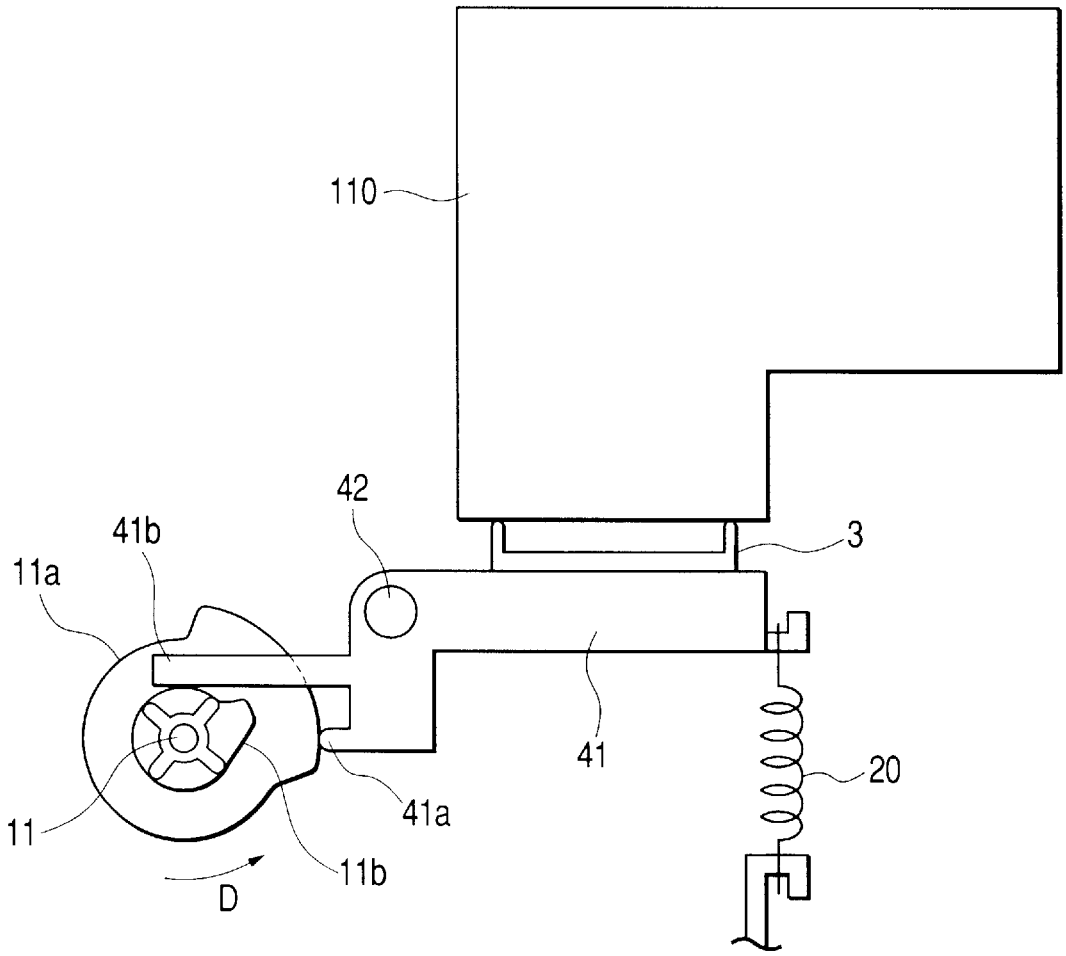
FIG. 7 is a schematic longitudinal sectional view showing a condition that a capping mechanism according to a second embodiment of the present invention is positioned in a capping position.
Figure 8:
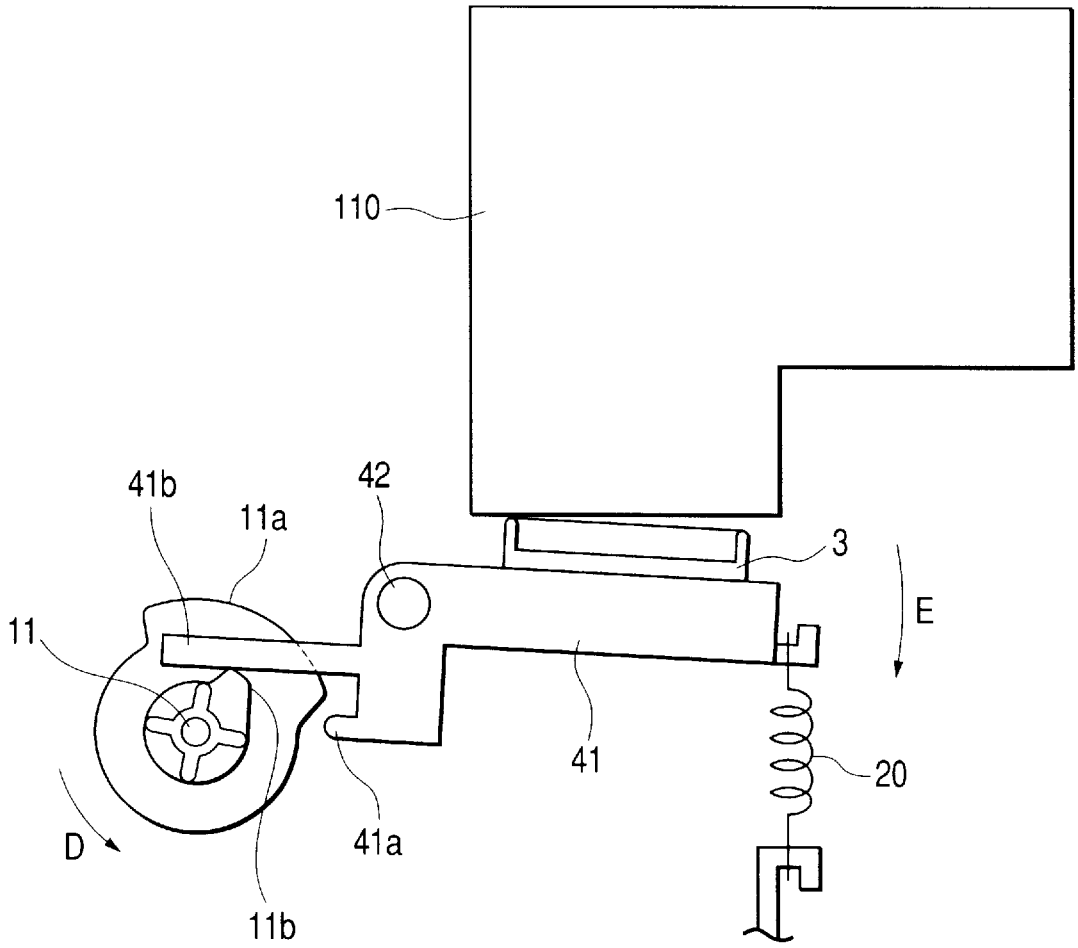
FIG. 8 is a schematic longitudinal sectional view showing a condition that the capping mechanism of FIG. 7 peels the cap adhered to the recording means.
Figure 9:
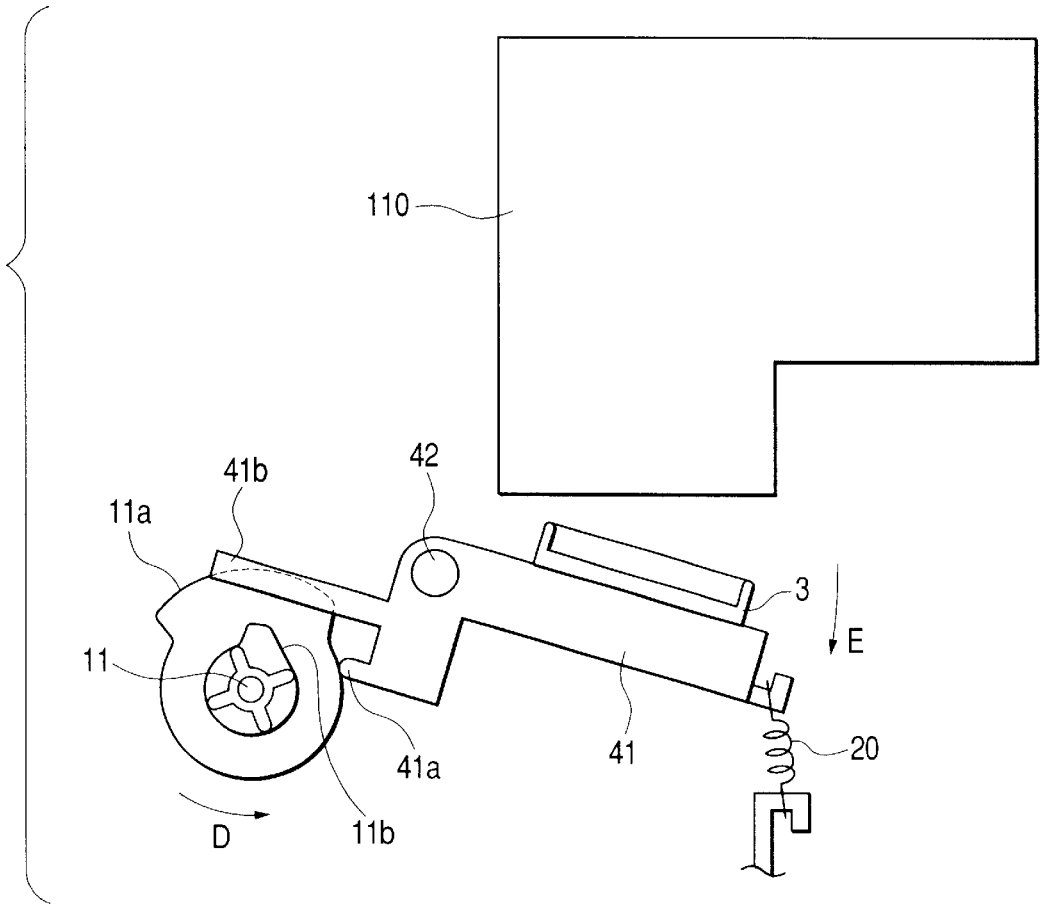
FIG. 9 is a schematic longitudinal sectional view showing a condition that the capping mechanism of FIG. 7 is positioned in a retard position spaced apart from the recording means.

FIGS. 7 to 9 show a capping mechanism according to a second embodiment of the present invention. FIG. 7 is a longitudinal sectional view showing a condition that a capping mechanism 30 (including a part of a driving mechanism) of the second embodiment is positioned in a capping position (closing position), FIG. 8 is a longitudinal sectional view showing a condition that a cap 3 adhered to a recording head 110 is peeled while lowering a cap base from the capping position, and FIG. 9 is a longitudinal sectional view showing a condition that the cap 3 of the capping mechanism 30 of the second embodiment is positioned at a retard position spaced apart from the recording head 110.

The capping mechanism according to the second embodiment shown in FIGS. 7 to 9 serves to protect the recording means (recording head) for effecting the recording by discharging the ink toward the recording medium and includes a cap 3 movable in directions along which the cap can be contacted with and separated from a discharge port face of a recording means 110, cam means (main cam 11) for controlling the position of the cap, and biasing means (return spring 20) for biasing the cap to be separated from the discharge port face, and in which the cam means includes first and second cams 43*a*, 43*b* and a cap holding member (cap holder) 41 includes first and second engagement portions 41*a*, 41*b* so that the first cam is normally engaged with the first engagement portion, and, when the first cam is disengaged from the first engagement portion (for example, when only disengaged), the second cam is engaged with the second engagement portion.

In the capping mechanism of the first embodiment explained in connection with FIGS. 3 to 6, while an example that the cap base 31 and the main cam 11 are connected via the cap lever 14 as the shifting means was explained, in the capping mechanism of the second embodiment shown in FIGS. 7 to 9, by providing the engagement portions (with respect to the main cam (cam means)) on the rockable cap holding member 41 (corresponding to the cap holder), an arrangement corresponding to the shifting means 14 of the first embodiment can be omitted, thereby simplifying the construction and reducing the cost.

In the condition that the cap 3 of FIG. 7 is in the closed position (capping position), the first engagement portion 41*a* of the cap holding member 41 is engaged by the first cam 43*a* of the main cam 11, with the result that the cap holding member 41 rockably (rotatably) supported by the support shaft 42 is forcibly displaced in an anti-clockwise direction in opposition to the return spring 20 as biasing means, thereby displacing the cap 3 to the capping position (uppermost position). Incidentally, here, while an example that the cap 3 directly secured to the cap holding member 41 effects the capping operation was explained, similar to the first embodiment, the cap may be biased toward the recording head 110 by providing a biasing member (for example, a spring) between the cap holding member 41 and the cap 3.

When the main cam 11 is rotated in a direction shown by the arrow D, the cap holding member 41 is rotated by the return spring (biasing means) 20 in a direction shown by the arrow E around the support shaft 42 in a condition that the first cam 43*a* is engaged by the first engagement portion 41*a*, thereby lowering the cap 3 downwardly to be spaced apart from the recording head 110. However, rarely, during the capping condition, the cap 3 may be adhered to the recording head 110, with the result that the cap 3 may not be peeled from the recording head 110 only by the force of the return spring 20. To cope with this, also in the second embodiment, as shown in FIG. 8, when the first cam 43*a* is disengaged from the first engagement portion 41*a*, the second cam 43*b* is engaged by the second engagement portion 41*b*. With this arrangement, even if the cap 3 is adhered to the recording head 110 not to be peeled from the recording head only by the return spring (biasing means) 20, the cap 3 can forcibly be shifted toward the retard position (downward direction) by forcibly shifting the cap holding member 41 in the direction E.

Namely, even if the cap 3 is adhered to the recording head 110, regardless of the force of the return spring 20, the cap 3 can positively be peeled from the recording head 110, thereby releasing the capping operation positively. Once the cap 3 is peeled, since the first cam 43*a* is engaged by the first engagement portion 41*a* again, the normal operation can be restored.

When the main cam (cam means) 11 is further rotated in the direction D, as shown in FIG. 9, the holding member 41 is further rotated by the return spring (biasing means) 20 in a clockwise direction (direction E in FIGS. 8 and 9) around the support shaft 42 in the condition that the first cam 11*a* is engaged by the first engagement portion 41*a*, thereby lowering the cap 3 to the lowermost position thereby to bring the cap 3 to the retard position spaced apart from the recording head 110. Since the capping mechanism (second embodiment) explained in connection with FIGS. 7 to 8 are substantially the same as the first embodiment except for the above-mentioned construction, detailed explanation thereof will be omitted.

Also in the above-mentioned second embodiment, the same effect as the first embodiment can be achieved. Namely, according to the second embodiment, since the rotatable (rockable) cap holding member 41 is biased by the return spring (biasing means) toward the retard direction spaced apart from the head 110 and the positions of the cap holding member 41 and the cap 3 are controlled by the main cam 11, the adhering condition of the cap 3 can be released without the aid of the force of the return spring (biasing means). Thus, there can be provided a capping mechanism in which, if the cap 3 is adhered to the recording means 110, the adhering condition can be released without the aid of the force of the biasing means 20, and the opening/closing error of the cap due to the adhesion between the recording means 110 and the cap 3 can be eliminated thereby achieving the correct opening/closing operation of the cap, and further, since the setting force of the return spring as the biasing means is not required to be increased, increase in load torque and increase in deformation/wear of the parts can be avoided, and an ink jet recording apparatus using such a capping mechanism. Further, according to the second embodiment, there can be provided a capping mechanism having fewer number of parts than the first embodiment and easier and cheaper construction.

Further, in the above-mentioned embodiments, while an example that the recording apparatus of serial type in which the recording is effected while shifting the recording means (recording head) in the main scanning direction was explained, the present invention can similarly be applied to a recording apparatus of line type (line type recording apparatus) in which recording is effected only by sub scanning by using recording means of line type having a length for covering the entire or part of width of the recording medium, thereby achieving the similar technical effect.

Further, the present invention can freely be carried out regardless of the number of the recording heads (recording means) and can similarly be applied to a recording apparatus using plural recording means, a gradation recording apparatus using plural recording means for effecting recording with same color and different densities or a recording apparatus having a combination thereof, as well as the recording apparatus having the single recording means, thereby achieving the similar technical effect. Further, the present invention can be applied to any arrangement in which the recording means is integrally formed with an ink tank to provide an exchangeable ink jet cartridge or the recording means is formed independently from the ink tank and the recording means and the ink tank are interconnected via an ink supplying tube, thereby achieving the similar technical effect.

Incidentally, in case of the ink jet recording apparatus, although the present invention can be applied to ink jet recording apparatuses using recording means utilizing an electrothermal converter such as a piezo-electric element, among them, the present invention gives excellent effect in an ink jet recording apparatus using recording means of type in which ink is discharged by utilizing thermal energy. According to such a system, high density and highly fine recording can be achieved.

What is claimed is:

1. A capping mechanism for protecting recording means for effecting recording by discharging ink toward a recording medium, comprising:

a cap movable in directions along which said cap can be contacted with and separated from a discharge port face of said recording means;

cam means for controlling a position of said cap;

shifting means for shifting said cap in said directions; and biasing means for biasing said cap to be separated from said discharge port face;

and wherein said cam means includes first and second cams and said shifting means includes first and second engagement portions so that said first cam is normally engaged with said first engagement portion, and, when said first cam is disengaged from said first engagement portion, said second cam is engaged with said second engagement portion.

2. A capping mechanism according to claim 1, wherein said mechanism includes said cap made of rubber elastic member, a cap holding member for holding said cap, a cap base for rockably supporting said cap holding member, and a biasing member disposed between said cap holding member and said cap base.

3. A capping mechanism for protecting recording means for effecting recording by discharging ink toward a recording medium, comprising:

a cap movable in directions along which said cap can be contacted with and separated from a discharge port face of said recording means;

cam means for controlling a position of said cap; and biasing means for biasing said cap to be separated from said discharge port face;

and wherein said cam means includes first and second cams and a cap holding member for holding said cap includes first and second engagement portions so that said first cam is normally engaged with said first engagement portion, and, when said first cam is disengaged from said first engagement portion, said second cam is engaged with said second engagement portion.

4. A capping mechanism according to claim 1 or 3, wherein, even if said recording means is adhered to said cap so that said cap cannot be separated from said recording means only by a biasing force of said biasing means, said second cam is engaged with said second engagement portion.

5. A capping mechanism according to claim 3, further comprising a biasing member disposed between said cap holding member and said cap.

6. An ink jet recording apparatus for effecting recording by discharging ink from recording means toward a recording medium, comprising:

a capping mechanism for protecting said recording means;

said capping mechanism including:

a cap movable in directions along which said cap can be contacted with and separated from a discharge port face of said recording means;

cam means for controlling a position of said cap;

shifting means for shifting said cap in said directions; and biasing means for biasing said cap to be separated from said discharge port face;

and wherein said cam means includes first and second cams and said shifting means includes first and second engagement portions so that said first cam is normally engaged with said first engagement portion, and, when said first cam is disengaged from said first engagement portion, said second cam is engaged with said second engagement portion.

7. An ink jet recording apparatus according to claim 6, wherein said capping mechanism includes said cap made of rubber elastic member, a cap holding member for holding said cap, a cap base for rockably supporting said cap holding member, and a biasing member disposed between said cap holding member and said cap base.

8. An ink jet recording apparatus according to claim 6, wherein said recording means includes an electrothermal converter for generating thermal energy utilized to discharge the ink.

9. An ink jet recording apparatus according to claim 8, wherein said recording means discharges the ink from a discharge port by utilizing film-boiling caused in the ink by the thermal energy generated by said electrothermal converter.

10. An ink jet recording apparatus for effecting recording by discharging ink from recording means toward a recording medium, comprising:

a capping mechanism for protecting said recording means;

said capping mechanism including:

a cap movable in directions along which said cap can be contacted with and separated from a discharge port face of said recording means;

cam means for controlling a position of said cap: and biasing means for biasing said cap to be separated from said discharge port face;

and wherein said cam means includes first and second cams and a cap holding member for holding said cap includes first and second engagement portions so that said first cam is normally engaged with said first engagement portion, and, when said first cam is disengaged from said first engagement portion, said second cam is engaged with said second engagement portion.

11. An ink jet recording apparatus according to claim 6 or 10, wherein, even if said recording means is adhered to said cap so that said cap cannot be separated from said recording means only by a biasing force of said biasing means, said second cam is engaged with said second engagement portion.

12. An ink jet recording apparatus according to claim 10, wherein said capping mechanism includes a biasing member disposed between said cap holding member and said cap.

* * * * *

UNITED STATES PATENT AND TRADEMARK OFFICE

CERTIFICATE OF CORRECTION

PATENT NO. : 6,629,749 B2
DATED : October 7, 2003
INVENTOR(S) : Miyauchi et al.

It is certified that error appears in the above-identified patent and that said Letters Patent is hereby corrected as shown below:

Column 1,
Line 15, “a” (first occurrence) should be deleted; and
Line 35, “of” should be deleted.

Column 2,
Line 5, “interfere’” should read -- interference --;
Line 15, “are” should read -- be --;
Line 34, “is” should read -- are --; and
Line 56, “to” should be deleted.

Column 4,
Line 27, “means.” should read -- means; --; and
Line 47, “by” (first occurrence) should be deleted.

Column 5,
Line 15, “effecting” should read -- effect --.

Column 7,
Line 34, “controlled” should read -- controlling --.

Column 9,
Line 29, “of” (first occurrence) should read -- is --.

Signed and Sealed this

Tenth Day of August, 2004

JON W. DUDAS
*Acting Director of the United States Patent and Trademark Office*